US011926899B2

(12) United States Patent
Munisamy

(10) Patent No.: US 11,926,899 B2
(45) Date of Patent: Mar. 12, 2024

(54) PROCESS FOR APPLICATION OF OXYHYDROXIDES COATING FOR ALUMINUM CONTAINING MATERIAL

(71) Applicant: Raytheon Company, Waltham, MA (US)

(72) Inventor: Thiru Munisamy, Medway, MA (US)

(73) Assignee: Raytheon Company, Tewksbury, MA (US)

( * ) Notice: Subject to any disclaimer, the term of this patent is extended or adjusted under 35 U.S.C. 154(b) by 558 days.

(21) Appl. No.: 17/111,646

(22) Filed: Dec. 4, 2020

(65) Prior Publication Data

US 2022/0178032 A1 Jun. 9, 2022

(51) Int. Cl.

| | |
|---|---|
| ***C23G 1/22*** | (2006.01) |
| ***C23C 22/66*** | (2006.01) |
| ***C23C 22/78*** | (2006.01) |
| *C23C 22/60* | (2006.01) |
| *C23G 1/14* | (2006.01) |

(52) U.S. Cl.

CPC ..... *C23C 22/66* (2013.01); *C23C 22/78* (2013.01); *C23G 1/22* (2013.01)

(58) Field of Classification Search

CPC ..... C23C 22/56; C23C 22/60; C23G 1/14–16; C23G 1/22

See application file for complete search history.

(56) References Cited

U.S. PATENT DOCUMENTS

| | | | |
|---|---|---|---|
| 2,018,694 A | 10/1935 | Wetherbee | |
| 2,819,192 A | 1/1958 | Young | |
| 4,028,205 A | 6/1977 | Dorsey, Jr. | |
| 4,149,912 A | 4/1979 | Craighead et al. | |
| 4,711,667 A | 12/1987 | Bibber | |
| 5,496,417 A | 3/1996 | Farrugia et al. | |
| 5,693,153 A | 12/1997 | Rosengard | |
| 6,123,782 A | 9/2000 | Rosengard | |
| 6,395,106 B1 | 5/2002 | Minevski et al. | |
| 2012/0231281 A1 | 9/2012 | Hirai et al. | |
| 2015/0020925 A1* | 1/2015 | Bares | C23C 22/34 148/273 |

FOREIGN PATENT DOCUMENTS

| | | |
|---|---|---|
| CN | 104630775 A | 5/2015 |
| CN | 110468400 A | 11/2019 |

(Continued)

OTHER PUBLICATIONS

Partial International Search Report dated Mar. 25, 2022 for corresponding application PCT/US2021/061699.

(Continued)

*Primary Examiner* — Lois L Zheng

(74) *Attorney, Agent, or Firm* — Bachman & LaPointe, P.C.

(57) ABSTRACT

A process for providing a surface of aluminum containing materials with a chromate-free protective coating includes degreasing a surface of an aluminum containing material to produce a degreased surface, treating the degreased surface in a high alkaline treatment immediately subsequent to the degreasing to produce an alkaline treated surface having smut on the surface, and treating the alkaline treated smut surface with a hydrothermal treatment immediately subsequent to the high alkaline treatment.

18 Claims, 2 Drawing Sheets

(56) References Cited

FOREIGN PATENT DOCUMENTS

| | | | |
|---|---|---|---|
| JP | S50158537 | A | 12/1975 |
| JP | 2016042183 | A | 3/2016 |

OTHER PUBLICATIONS

Mariana Paz Martínez-Viademonte et al., "A Review on Anodizing of Aerospace Aluminum Alloys for Corrosion Protection", Coatings, vol. 10, No. 11, Nov. 18, 2020, pp. 1-30, XP055849321, DOI: 10.3390/coatings10111106.
International Search Report and Written Opinion dated Aug. 8, 2022 for corresponding application PCT/US2021/061699.

* cited by examiner

PROCESS FOR APPLICATION OF OXYHYDROXIDES COATING FOR ALUMINUM CONTAINING MATERIAL

BACKGROUND

The present disclosure relates to a process for pretreating the surface of an aluminum containing material that replaces chromate conversion coatings for organic coating applications.

Aluminum, aluminum alloys, and other aluminum containing materials are frequently used to form structures requiring corrosion resistance. Protection against corrosion may be achieved by application of organic protective coatings (e.g., primer, topcoat paints). Aluminum being an active metal can readily undergo oxidation/corrosion reactions, but the presence of a relatively thin non-continuous natural native oxide layer (3-6 nm) on the surface provides a level of corrosion protection. This natural oxide film may not be sufficiently resistant to highly corrosive environments such as saltwater, nor provide a sufficient base for paints. Improved films, which are both more corrosion resistant and suitable as a base for paints can generally be formed on the surface of the aluminum containing material by anodizing or by chromate conversion processes.

In the field of chemical conversion coatings, hexavalent chromium ion ($Cr^{6+}$) based chromate conversion coatings are commonly used for standalone corrosion protection of aluminum and as an adhesion layer basecoat for bonding and painting applications. For fielding of products in aggressive corrosive environments, the aluminum is typically painted, with the hexavalent-based chromate conversion coating as a basecoat followed by a layer of polymer epoxy as primer and polymer polyurethane as topcoat. In the system of three distinctive layers for paint applications, the chromate operates as an adhesion layer, the primer operates as a corrosion inhibitor layer providing the bulk of the corrosion protection, and the topcoat operates as a barrier/UV protection layer. In some systems, a hexavalent-based chromate wash primer is directly sprayed onto the metal surface to form a basecoat. Coatings with hexavalent chromium ion show excellent performance, reliability, and were considered as the standard for decades. However, hexavalent chromium ion may have deleterious effects and is being phased out of future designs and applications.

One of the manufacturing and field issues observed for chromate coatings is the proper adhesion of primer because of ageing and structural changes that occur at the water bonded $Cr^{3+}$—O—$Cr^{6+}$ backbone of the coating and the resulting hydrophobicity. Alternatives (e.g., trivalent chromium ion based coatings and zirconium based coatings) are commercially available but may not provide satisfactory performance. In general, chromate conversion coating (CCC) processes involve multiple steps with complex and toxic chemical formulations. For example, commonly used specification MIL-DTL-5541 specifies Type 1 (hexavalent-based chromate) and Type II (trivalent-based chromate) coatings with chemical solution tanks such as alkaline degreaser, alkaline etch, acid deoxidizer and chromate coating tank are used to produce the final coating. Each chemical process tank is necessarily followed by a rinse water tank, thus contributing to an increased environmental footprint.

SUMMARY

A process according to one disclosed non-limiting embodiment of the present disclosure includes degreasing a surface of an aluminum containing material to produce a degreased surface; treating the degreased surface in a high alkaline treatment immediately subsequent to the degreasing to produce an alkaline treated surface having smut on the surface; and treating the alkaline treated surface with a hydrothermal treatment immediately subsequent to the high alkaline treatment providing the surface of the aluminum containing material with a chromate-free coating.

A further embodiment of any of the foregoing embodiments of the present disclosure includes that the degreasing includes treating the surface in an immersion tank for 5-10 minutes.

A further embodiment of any of the foregoing embodiments of the present disclosure includes that the degreasing is conducted at a pH of 9-11 and temperature of 110-150 F (43-66 C).

A further embodiment of any of the foregoing embodiments of the present disclosure includes that the step of treating the surface in a high alkaline treatment is conducted in an immersion tank containing a highly alkaline solution for 30 seconds-3 minutes.

A further embodiment of any of the foregoing embodiments of the present disclosure includes that the step of treating the surface in a high alkaline treatment is conducted at a temperature of 135-150 F (57-66 C), with a pH greater than 12.

A further embodiment of any of the foregoing embodiments of the present disclosure includes that the highly alkaline solution contains 15-60 g/l sodium hydroxide (NaOH), 5-20 g/l sodium bicarbonate ($NaHCO_3$), 5-10 g/l sodium nitrate ($NaNO_3$) with sodium sulfide ($Na_2S$), triethanolamine ($C_6H_{15}NO_3$) and potassium gluconate ($C_6H_{11}KO_7$).

A further embodiment of any of the foregoing embodiments of the present disclosure includes that the smut from the high alkaline treatment is not removed and the aluminum is directly subjected to the hydrothermal treatment, the smut includes oxyhydroxides of aluminum and other metals present in the aluminum containing material.

A further embodiment of any of the foregoing embodiments of the present disclosure includes that the oxyhydroxides comprise one or more of $NaAl(OH)_4$, $Al(OH)_3$, $Mg(OH)_2$, $Cu(OH)_2$, CuO, $Cu_2O$, $Cu_2S$, $Na_2Zn(OH)_4$, $SiO_2.xH_2O$.

A further embodiment of any of the foregoing embodiments of the present disclosure includes that the step of treating the surface with the hydrothermal treatment is conducted for 20-60 minutes.

A further embodiment of any of the foregoing embodiments of the present disclosure includes that the step of treating the surface with the hydrothermal treatment includes immersing the surface in a tank containing deionized water at 185-212 F (85-100 C) with pH of 6.4 for 20-30 minutes.

A further embodiment of any of the foregoing embodiments of the present disclosure includes that the step of treating the surface with the hydrothermal treatment includes exposing the surface to steam at 250-270 F (121-132 C) and 30-35 PSI for 50-60 minutes.

A further embodiment of any of the foregoing embodiments of the present disclosure includes degreasing the aluminum in an immersion tank for 5-10 minutes; treating the aluminum in a high alkaline treatment immersion tank for 30 seconds-3 minutes; and treating the aluminum with the hydrothermal treatment for 20-60 minutes.

A further embodiment of any of the foregoing embodiments of the present disclosure includes painting or bonding the aluminum containing material subsequent to the hydrothermal treatment.

A process according to one disclosed non-limiting embodiment of the present disclosure includes degreasing a surface of an aluminum containing material in an immersion tank for 5-10 minutes at a pH of 9-11 and temperature of 110-150 F (43-66 C) to produce a degreased surface; treating the degreased surface in a high alkaline treatment immersion tank immediately subsequent to the degreasing for 30 seconds-3 minutes at a temperature of 135-150 F (57-66 C), with a pH greater than 12 to produce an alkaline treated surface having smut on the surface; and treating the alkaline treated surface with a hydrothermal treatment immediately subsequent to the high alkaline treatment for 20-60 minutes, wherein smut from the high alkaline treatment is not removed and the aluminum alkaline treated surface having smut on the surface is directly subjected to the hydrothermal treatment immersion providing the surface of the aluminum containing material with a chromate-free coating.

A further embodiment of any of the foregoing embodiments of the present disclosure includes that the highly alkaline solution in the high alkaline treatment immersion tank contains 15-60 g/l sodium hydroxide (NaOH), 5-20 g/l sodium bicarbonate ($NaHCO_3$), 5-10 g/l sodium nitrate ($NaNO_3$) with sodium sulfide ($Na_2S$), triethanolamine ($C_6H_{15}NO_3$) and potassium gluconate ($C_6H_{11}KO_7$) and the high alkaline treatment immersion forms the smut which are oxyhydroxides of the aluminum and other metals present in aluminum containing material, wherein the oxyhydroxides comprise one or more of $NaAl(OH)_4$, $Al(OH)_3$, $Mg(OH)_2$, $Cu(OH)_2$, $Cu_2O$, CuO, $Cu_2S$, $Na_2Zn(OH)_4$, $SiO_2.xH_2O$.

A further embodiment of any of the foregoing embodiments of the present disclosure includes that the hydrothermal treatment includes de-ionized water at 185-212 F (85-100 C) with a pH of 6.4 for 20-30 minutes.

A further embodiment of any of the foregoing embodiments of the present disclosure includes that the hydrothermal treatment includes steam at 250-270 F (121-132 C) and 30-35 PSI for 50-60 minutes.

A further embodiment of any of the foregoing embodiments of the present disclosure includes painting and/or bonding the aluminum containing material subsequent to the hydrothermal treatment.

A process according to one disclosed non-limiting embodiment of the present disclosure includes degreasing a surface of an aluminum containing material in an immersion tank for 5-10 minutes at a pH of 9-11 and temperature of 110-150 F (43-66 C) to produce a degreased surface; treating the degreased surface in a first high alkaline treatment immersion tank immediately subsequent to the degreasing to produce an alkaline treated surface having smut on the surface; deoxidizing the alkaline treated surface having smut on the surface subsequent to the first high alkaline treatment; treating the deoxidized and the alkaline treated surface in a second high alkaline treatment immersion tank immediately subsequent to the deoxidizing for 30 seconds-3 minutes at a temperature of 135-150 F (57-66 C), with a pH greater than 12; and treating the aluminum with a hydrothermal treatment immediately subsequent to the high alkaline treatment for 20-60 minutes, wherein smut from the high alkaline treatment is not removed and the aluminum is directly subjected to the hydrothermal treatment immersion providing the surface of the aluminum containing material with a chromate-free coating.

A further embodiment of any of the foregoing embodiments of the present disclosure includes painting and/or bonding the aluminum containing material subsequent to the hydrothermal treatment.

The foregoing features and elements may be combined in various combinations without exclusivity, unless expressly indicated otherwise. These features and elements as well as the operation of the invention will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
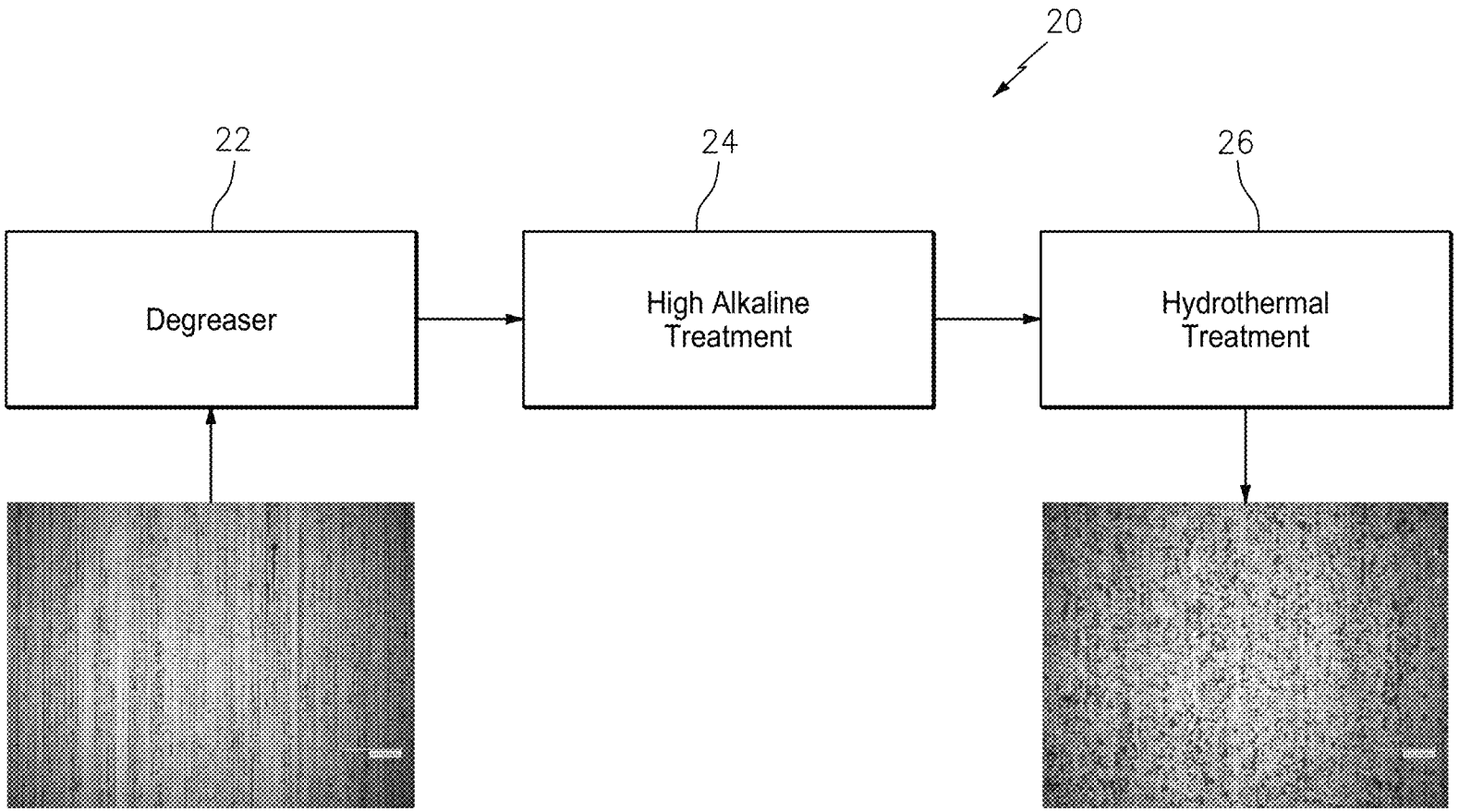
FIG. 1 is a schematic of a process for application of a basecoat on aluminum according to one disclosed non-limiting embodiment.

FIG. 1 schematically illustrates a process 20 for application of a basecoat to be formed on aluminum with non-toxic chemical steps that can be used to replace hexavalent-based conversion coatings and other complex coating systems based on trivalent chromium and zirconium chemistries. The process 20 may be referred to herein as ALSC (Aluminum (AL) Smut (S) Coating (C)) and takes advantage of an alloy oxyhydroxides film formed on the aluminum surface during the high alkaline treatment step. In the disclosed embodiment, the ALSC process 20 is defined by three chemical immersions within an associated immersion tank (not shown). The process 20 generally includes a degreaser immersion (step 22), a high alkaline treatment immersion (step 24), and a hydrothermal treatment immersion (step 26). Each immersion is for a relatively long period of time, e.g., the degreaser step (step 22) for 5-10 minutes, the high alkaline treatment immersion (step 24) for 30 seconds-3 minutes, and the hydrothermal treatment immersion (step 26) for 20-60 minutes.

Aluminum is widely used in military, aerospace, automotive, and medical industries because of its high strength to weight ratio, tunable functional properties and recyclability. Wrought (e.g., 6061, 5052) and cast (e.g., A356, A380) aluminum alloys are routinely utilized for several applications.

The term "aluminum" in connection with the substrate metal to be treated includes the aluminum alloys with aluminum content varying from 85% to 99% and the aluminum alloys which are generally subjected to a cleaning and deoxidizing treatment prior to chromating or other chemical or electrochemical treatments. Aluminum alloys generally contain larger amounts of other alloying metals such as silicon, chromium, lead, iron, copper, magnesium, manganese, zinc and the like. As used herein, aluminum containing material includes aluminum alloys containing more than 85% by weight aluminum. All references to percent composition herein are weight percent unless noted otherwise.

Initially, the degreaser immersion (step 22) of the ALSC process 20 provides the cleaning of the aluminum in an alkaline solution to remove coolants, oil, grease, and machining contaminants from the metal surfaces. A water break free surface is obtained during this process step indicating that the aluminum is ready for the next processing step.

One degreaser solution may contain, for example, alkaline salts (i.e., sodium or potassium silicates and phosphates), surfactants, sequestrants, and solvents as components and operates at pH of 9-11 and temperature of 110-150 F (43-66 C). In one embodiment, the immersion time may be 5-10 minutes. Commercially available Chemetall Aluminum Cleaner NST manufactured by BASF of New Jersey, USA; or a bath with composition similar to above may be utilized. A rinse (e.g., tap water or deionized (DI) water) bath may optionally follow the degreaser bath to remove residual chemistries. This extra rinse bath can be omitted by spray rinsing the cleaned metal over the degreaser bath or moved without rinsing to the next process (step 24) which has similar pH and chemistries. The aluminum surface may be wiped with isopropyl alcohol or acetone soaked cloth to remove organic contaminants before the degreaser step.

Next, the high alkaline treatment immersion (step 24) of the ALSC process 20 involves processing the cleaned aluminum in a highly alkaline solution containing, for example, 15-60 g/l sodium hydroxide (NaOH), 5-20 g/l sodium bicarbonate ($NaHCO_3$), 5-10 g/l sodium nitrate ($NaNO_3$), sodium sulfide ($Na_2S$), triethanolamine ($C_6H_{15}NO_3$) and potassium gluconate ($C_6H_{11}KO_7$). The bath is operated at a temperature of 135-150 F (57-66 C), with a pH greater than 12. In one embodiment, the immersion time in the solution may be from 30 seconds to 3 minutes.

During the high alkaline treatment immersion (step 24), oxyhydroxides of aluminum and other metals present in aluminum alloys matrix, such as $NaAl(OH)_4$, $Al(OH)_3$, $Mg(OH)_2$, $Cu(OH)_2$, $Cu_2O$, CuO, $Cu_2S$, $Na_2Zn(OH)_4$, $SiO_2.xH_2O$ or mixed metal oxyhydroxides are formed on the aluminum. See Equations 1-5 for examples of oxyhydroxides formation reactions.

$$2Al+2NaOH+6H_2O \rightarrow 2NaAl(OH)_4+3H_2 \quad (1)$$

$$Mg+2(OH)^- \rightarrow Mg(OH)_2+2e^- \quad (2)$$

$$Si+2H_2O \rightarrow SiO_2+2H_2 \quad (3)$$

$$Cu_2O+H_2O+2OH^- \rightarrow 2Cu(OH)_2+2e^- \quad (4)$$

$$2Cu+2OH^- \rightarrow Cu_2O+H_2O+2e^- \quad (5)$$

The formation of metal oxyhydroxides is confirmed by X-ray Photoelectron Spectroscopy (XPS) analysis, which showed the presence of elements related to metal oxyhydroxides on high alkaline treated surfaces (e.g., Al, Mg, O, Si, Cu and Cr on 6061 aluminum alloy), while the surfaces of bare or coated aluminum did not show all the elements listed above. The oxyhydroxides turn the metal surface to shades of grey or black color with an iridescence. The color and thickness of the formed film varies depending on the composition of aluminum alloys (e.g., 6061, 2024, 7075), processing time, and high alkaline bath activity (i.e., etch rate). For example, on 2024 aluminum, a light black film is observed due to the presence of copper sulfide and/or copper (II) oxide, while on 6061 aluminum a light grey film is observed due to the presence of magnesium hydroxide and hydrated silicon dioxide. The aluminum may then be rinsed in tap or DI water to remove residual alkaline chemistries.

The high alkaline treatment immersion (step 24) of aluminum results in a vigorous reaction to generate free hydrogen, heat, and complex oxides and hydroxides of aluminum and other metals present in aluminum alloys matrix. Some of these reaction products, for example magnesium hydroxide, copper sulfide, copper oxide, chromium oxide, silicon oxide, are insoluble and remain on the surface of the aluminum in the form of "smut". Typically, the smut is removed by using acidic chemistries in chromate and anodizing processing. In the disclosed embodiment, the smut is not removed and the aluminum is directly subjected to the hydrothermal treatment immersion (step 26) to form the smut coating.

The hydrothermal treatment immersion (step 26) of the ALSC process 20 involves converting the film formed in high alkaline treatment immersion (step 24) to an adherent functional coating. The hydrothermal treatment immersion (step 26) may be performed in a boiling de-ionized water at 185-212 F (85-100 C) with pH of 6.4 for 20-30 minutes. Alternatively, the hydrothermal treatment immersion (step 26) may be performed in steam at 250-270 F (121-132 C) and 30-35 PSI for 50-60 minutes.

The final coating composition measured by XPS and Scanning Electron Microscopy-Energy-Dispersive X-ray Spectroscopy (SEM-EDS) on a 6061 aluminum alloy consists of aluminum (63 wt %), magnesium (1.8 wt %), iron (2 wt %), copper (1.7 wt %) and oxygen (31 wt %) when treated by steam (SEM-EDS measurement), and aluminum (18 at %), magnesium (0.4 at %), carbon (16 at %) and oxygen (65 at %) when treated by boiling DI water (XPS measurement). On a 2024 aluminum alloy, the A1SC coating consists of aluminum (37 wt %), copper (1 wt %), magnesium (1 wt %), manganese (3 wt %), carbon (3 wt %) and oxygen (54 wt %) when treated by steam (SEM-EDS measurement). Mechanical cross-section/SEM and XPS show a thickness range of 0.45-4 μm for ALSC. The thickness is controlled by the processing time and conditions of high alkaline treatment immersion (step 24) and hydrothermal treatment immersion (step 26).

Figure 2:
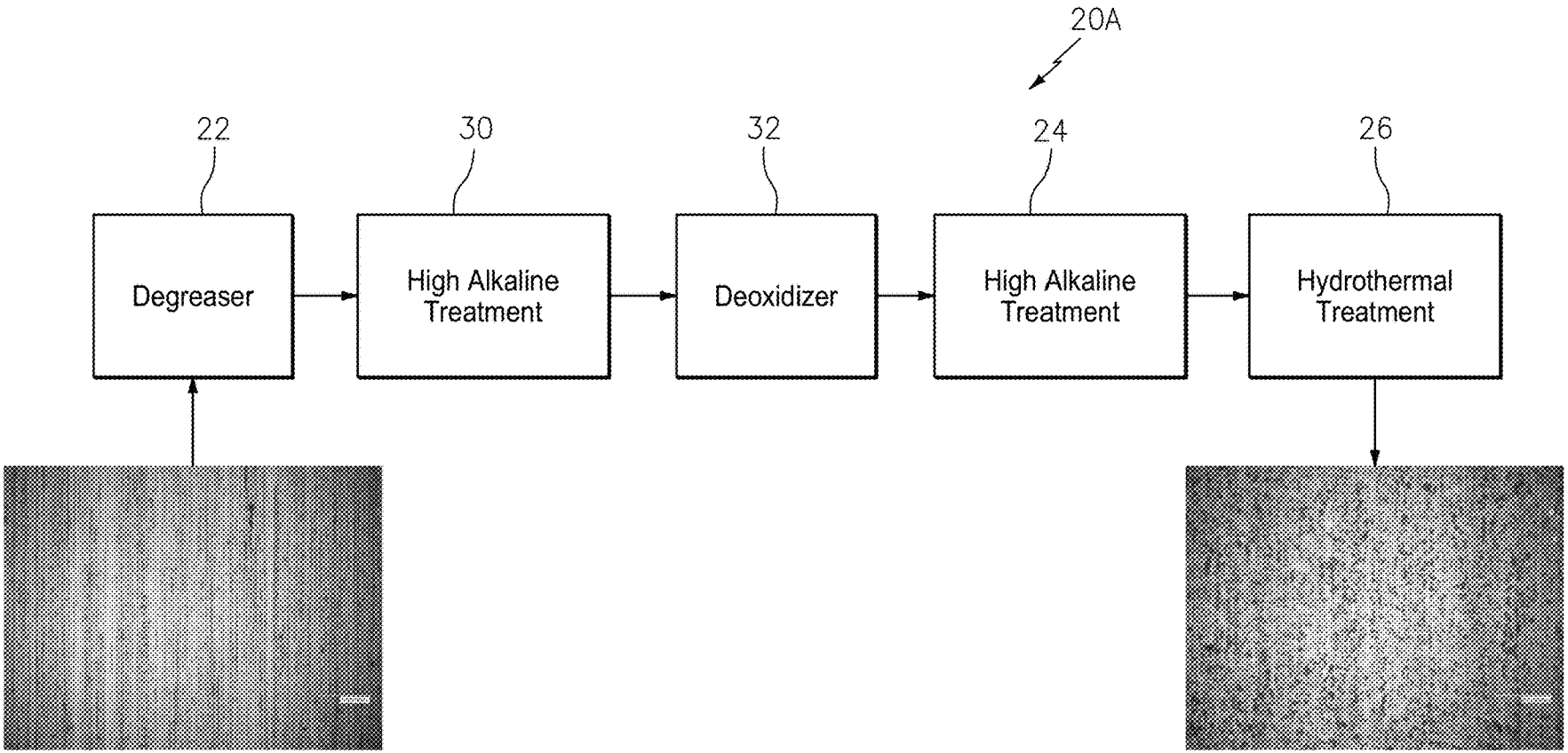
FIG. 2 is a schematic of a process for application of a basecoat on aluminum according to another disclosed non-limiting embodiment.

With reference to FIG. 2, an alternate embodiment of the ALSC process 20A involves an additional high alkaline treatment (step 30) followed by a deoxidizer treatment (step 32) prior to the high alkaline treatment immersion (step 24). The high alkaline treatment (step 30) may be equivalent to the high alkaline treatment immersion (step 24). The additional high alkaline treatment (step 30) and deoxidizer treatment (step 32) are used to provide a fresh bulk-like composition on the surface before ALSC coating formation.

After the aluminum substrate is treated in accordance with the ALSC process, the treated aluminum may be used standalone in high pH/caustic/oxidizing environments or painted or adhesive bonded or otherwise finished with a curable organic protectant (step 28).

The coating formed on the aluminum by the ALSC process has the potential to replace chromate conversion coatings for paint and adhesive bonding applications. Testing has shown that the ALSC surface has high surface energy and wettability compared to a Type I chromated surface. For example, contact angle measurements showed 17° for ALSC, 90° for TY I chromate, 80° for TY III sealed anodize, 36° for TY III unsealed anodize, 36° for hydrothermal only treated surface and 86° for bare 6061 Al alloy. ALSC has the lowest contact angle value among the measured samples and it shows the hydrophilicity nature of ALSC compared to hydrophobicity of other measured samples especially chromate and sealed anodize surfaces. This property would be advantages and may result in minimal or no surface preparation of the ALSC surface before painting and bonding unlike chromate and anodize coatings. Primer (e.g., MIL-PRF-23377) adhesion testing on ALSC surface per ASTM D3359 Methods A and B showed a rating of 5A and 5B, respectively. In addition, a steam treated ALSC surface aged for 24 months and coated with a primer, passed wet tape adhesion test per MIL-DTL-5541 and FED-STD-141 Method 6301.3 with minimal surface preparation. A 168 hours salt spray testing per ASTM B117 for an ALSC surface coated with primer showed no blistering, lifting of coating nor corrosion. There were some corrosion on the X-cut areas and unprotected bare metal edges but no creep corrosion observed. Adhesion of primer post salt spray (168 hours) was better for ALSC compared to Type I chromate, which showed some peeling off of primer near X-cut interfaces (>1 mm, 3A per ASTM D3359 Method A). Based on the studied properties of ALSC, it has the potential to be used as TT-C-490 Type IV and MIL-DTL-5541 QPL/QPD coating material.

Other applications such as adhesive bonding and coolant contact areas can benefit from ALSC process. The ALSC coating resists caustic chemical attack and can be used on aluminum for high pH/oxidizing environments. Medical device companies who use Sterrad and Steris systems and automotive companies who use products in GMV 14665 like conditions can benefit from standalone ALSC. The coating passes GMV 14665 pH 13.5 test and performs better than anodize coatings when immersed in an alkaline etch solution containing 40 g/l sodium hydroxide, 5 mill Triton X-100, 8.5 g/l sodium nitrate, 2-5 g/l 2024 Al metal chips and 8.4 g/l sodium bicarbonate. Weight loss method and visual inspection show that anodize coatings (MIL-A-8625, TY III hardcoat, 0.002" thick, sealed and unsealed) degrade completely in 15 minutes in the above mentioned alkaline etch solution, whereas the integrity of 66-94% of the ALSC coatings remain unaffected.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason, the appended claims should be studied to determine true scope and content.

What is claimed is:

1. A process for coating a surface of an aluminum containing material, comprising:

degreasing a surface of an aluminum containing material to produce a degreased surface;

treating the degreased surface in a high alkaline treatment immediately subsequent to the degreasing to produce an alkaline treated surface having smut on the surface, wherein the highly alkaline solution contains 15-60 g/l sodium hydroxide (NaOH), 5-20 g/l sodium bicarbonate ($NaHCO_3$), 5-10 g/l sodium nitrate ($NaNO_3$) with sodium sulfide ($Na_2S$), triethanolamine ($C_6H_{15}NO_3$) and potassium gluconate ($C_6H_{11}KO_7$); and treating the alkaline treated surface with a hydrothermal treatment immediately subsequent to the high alkaline treatment providing the surface of the aluminum containing material with a chromate-free coating.

2. The process as recited in claim 1, wherein the degreasing comprises treating the surface in an immersion tank for 5-10 minutes.

3. The process as recited in claim 2, wherein the degreasing is conducted at a pH of 9-11 and temperature of 110-150 F (43-66 C).

4. The process as recited in claim 1, wherein the step of treating the surface in a high alkaline treatment is conducted in an immersion tank containing a highly alkaline solution for 30 seconds-3 minutes.

5. The process as recited in claim 4, wherein the step of treating the surface in a high alkaline treatment is conducted at a temperature of 135-150 F (57-66 C), with a pH greater than 12.

6. The process as recited in claim 1, wherein the smut from the high alkaline treatment is not removed and the aluminum is directly subjected to the hydrothermal treatment, the smut comprises oxyhydroxides of aluminum and other metals present in the aluminum containing material.

7. The process as recited in claim 6, wherein the oxyhydroxides comprise one or more of $NaAl(OH)_4$, $Al(OH)_3$, $Mg(OH)_2$, $Cu(OH)_2$, CuO, $Cu_2O$, $Cu_2S$, $Na_2Zn(OH)_4$, $SiO_2.xH_2O$.

8. The process as recited in claim 1, wherein the step of treating the surface with the hydrothermal treatment is conducted for 20-60 minutes.

9. The process as recited in claim 8, wherein the step of treating the surface with the hydrothermal treatment comprises immersing the surface in a tank containing de-ionized water at 185-212 F (85-100 C) with pH of 6.4 for 20-30 minutes.

10. A process for coating a surface of an aluminum containing material, comprising:

degreasing a surface of an aluminum containing material to produce a degreased surface;

treating the degreased surface in a high alkaline treatment immediately subsequent to the degreasing to produce an alkaline treated surface having smut on the surface; and treating the alkaline treated surface with a hydrothermal treatment immediately subsequent to the high alkaline treatment providing the surface of the aluminum containing material with a chromate-free coating, wherein the step of treating the surface with the hydrothermal treatment comprises exposing the surface to steam at 250-270 F (121-132 C) and 30-35 PSI for 50-60 minutes.

11. The process as recited in claim 1, further comprising:

degreasing the aluminum in an immersion tank for 5-10 minutes;

treating the aluminum in a high alkaline treatment immersion tank for 30 seconds-3 minutes; and treating the aluminum with the hydrothermal treatment for 20-60 minutes.

12. The process as recited in claim 1, further comprising painting or bonding the aluminum containing material subsequent to the hydrothermal treatment.

13. A process for coating a surface of an aluminum containing material, comprising:

degreasing a surface of an aluminum containing material in an immersion tank for 5-10 minutes at a pH of 9-11 and temperature of 110-150 F (43-66 C) to produce a degreased surface;

treating the degreased surface in a high alkaline treatment immersion tank immediately subsequent to the degreasing for 30 seconds-3 minutes at a temperature of 135-150 F (57-66 C), with a pH greater than 12 to produce an alkaline treated surface having smut on the surface; and treating the alkaline treated surface with a hydrothermal treatment immediately subsequent to the high alkaline treatment for 20-60 minutes, wherein smut from the high alkaline treatment is not removed and the aluminum alkaline treated surface having smut on the surface is directly subjected to the hydrothermal treatment immersion providing the surface of the aluminum containing material with a chromate-free coating, wherein the highly alkaline solution in the high alkaline treatment immersion tank contains 15-60 g/l sodium hydroxide (NaOH), 5-20 g/l sodium bicarbonate ($NaHCO_3$), 5-10 g/l sodium nitrate ($NaNO_3$) with sodium sulfide ($Na_2S$), triethanolamine ($C_6H_{15}NO_3$) and potassium gluconate ($C_6H_{11}KO_7$) and the high alkaline treatment immersion forms the smut which are oxyhydroxides of the aluminum and other metals present in aluminum containing material, wherein the oxyhydroxides comprise one or more of $NaAl(OH)_4$, $Al(OH)_3$, $Mg(OH)_2$, $Cu(OH)_2$, $Cu_2O$, CuO, $Cu_2S$, $Na_2Zn(OH)_4$, $SiO_2.xH_2O$.

14. The process as recited in claim 13, wherein the hydrothermal treatment comprises de-ionized water at 185-212 F (85-100 C) with a pH of 6.4 for 20-30 minutes.

15. The process as recited in claim 13, wherein the hydrothermal treatment comprises steam at 250-270 F (121-132 C) and 30-35 PSI for 50-60 minutes.

16. The process as recited in claim 13, further comprising painting and/or bonding the aluminum containing material subsequent to the hydrothermal treatment.

17. A process for coating a surface of an aluminum containing material, comprising:

degreasing a surface of an aluminum containing material in an immersion tank for 5-10 minutes at a pH of 9-11 and temperature of 110-150 F (43-66 C) to produce a degreased surface;

treating the degreased surface in a first high alkaline treatment immersion tank immediately subsequent to the degreasing to produce an alkaline treated surface having smut on the surface;

deoxidizing the alkaline treated surface having smut on the surface subsequent to the first high alkaline treatment;

treating the deoxidized and the alkaline treated surface in a second high alkaline treatment immersion tank immediately subsequent to the deoxidizing for 30 seconds-3 minutes at a temperature of 135-150 F (57-66 C), with a pH greater than 12; and treating the aluminum with a hydrothermal treatment immediately subsequent to the high alkaline treatment for 20-60 minutes, wherein smut from the high alkaline treatment is not removed and the aluminum is directly subjected to the hydrothermal treatment immersion providing the surface of the aluminum containing material with a chromate-free coating.

18. The process as recited in claim 17, further comprising painting and/or bonding the aluminum containing material subsequent to the hydrothermal treatment.

* * * * *